US005248047A

United States Patent [19]

Randhawa

[11] Patent Number: 5,248,047

[45] Date of Patent: Sep. 28, 1993

[54] ACCESSORY DISPLAY AND STORAGE APPARATUS

[76] Inventor: Simran P. Randhawa, 102 Sharon St., Bamberg, S.C. 29003

[21] Appl. No.: 777,070

[22] Filed: Oct. 16, 1991

[51] Int. Cl.[5] ..... A47F 7/00

[52] U.S. Cl. ..... 211/13; 211/163; 211/124; 223/66; 223/68; 223/84

[58] Field of Search ..... 211/13, 131, 144, 163, 211/170, 171, 205, 4, 124; 223/66, 84, 68

[56] References Cited

U.S. PATENT DOCUMENTS

| | | | |
|---|---|---|---|
| 2,451,674 | 10/1948 | Hade | 211/205 X |
| 3,084,837 | 4/1963 | Wolf | 223/68 |
| 3,310,180 | 3/1967 | Neagle | 211/205 |
| 3,734,301 | 5/1973 | Rastocny | 211/205 |
| 4,109,794 | 8/1978 | Samuel et al. | 211/13 |
| 4,289,246 | 9/1981 | Scott | 211/205 |
| 4,351,441 | 9/1982 | Schramm | 211/205 X |
| 4,756,429 | 7/1988 | Lehman et al. | 211/163 X |

FOREIGN PATENT DOCUMENTS

| | | | |
|---|---|---|---|
| 440148 | 12/1967 | Switzerland | 211/205 |
| 760770 | 11/1956 | United Kingdom | 211/170 |

OTHER PUBLICATIONS

Standard Fixture Company, Inc. Catalogue, pp. 8, 12, 19, 27 and 30.

Red Wing Products, Inc. Wholesale Catalog, Oct. 1990, pp. 41 and 74.

ABC Display and Supply, Inc. Catalog, Jan. 1990, pp. 16, 72, 79, 80 and 81.

*Primary Examiner*—Blair M. Johnson

*Attorney, Agent, or Firm*—Dority & Manning

[57] ABSTRACT

The present invention relates generally to a space efficient garment storage and display apparatus that includes a support stand and a plurality of display units. The display units include display racks supported by an upright support frame and having storage bars extending across each respective display rack. The storage bars simultaneously display and store garments, such as scarves and the like, which are wrapped or draped therearound. The display units may further include a silhouette located generally above the display racks for displaying the garments as they would normally be worn.

25 Claims, 6 Drawing Sheets

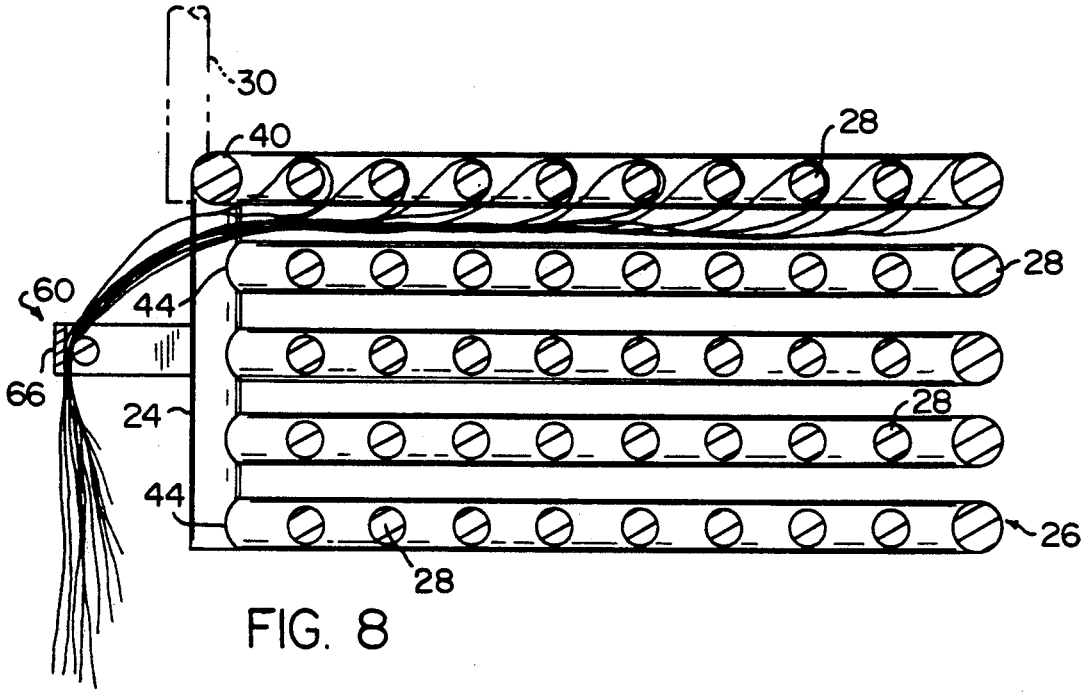
FIG. 8
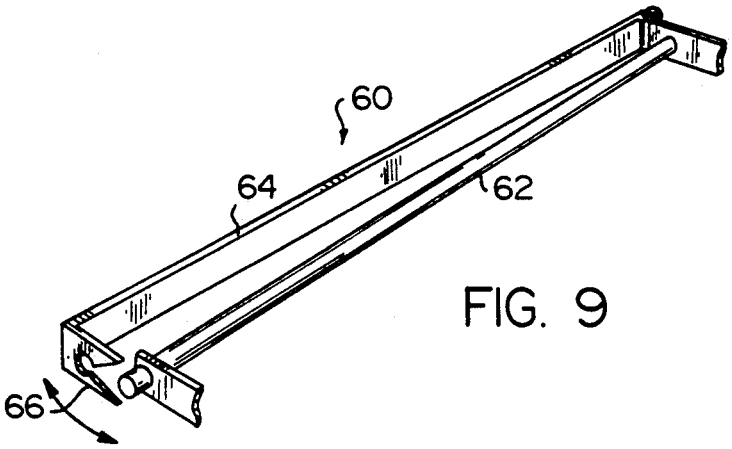
FIG. 9
FIG. 10
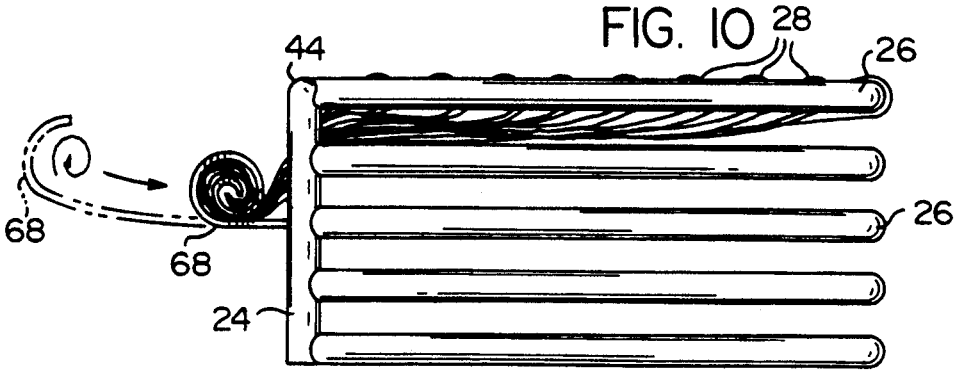

ACCESSORY DISPLAY AND STORAGE APPARATUS

Background of the Invention

This invention relates generally to an apparatus for storing and displaying garments such as scarves and the like and, more particularly, a convenient and effective storage and display unit for displaying and storing a large number of accessories, such as scarves and the like, in a space efficient and attractive manner. In the fashion industry, effective display is extremely important. It is especially important with an accessory such as scarves, since they come in a variety of shapes, countless fabrications, and a multitude of prints. Retailers must frequently rearrange scarves in conventional displays. In a conventional display, the customer must pull the article to examine color, texture, and size of the garment. This results in the scarves and the like being left in total disarray and requires employees to spend valuable time rearranging the garments back into a presentable condition. Furthermore, conventional displays require a relatively large floor space area thereby lowering the dollar volume per square foot of retail space. Additionally, conventional displays facilitate shoplifting resulting in substantial losses to retailers.

Various display devices and stands are commonly known and utilized in the field for displaying accessories. For example, it is commonly known to use upright stands with arms extending therefrom for hanging or clipping garments thereto. It is further known that these arms may revolve or rotate around the stand. Stationary type units have also been utilized that may be attached to walls or support structures with scarves or garments hung therefrom. Scarves are displayed from wall devices having holes therein through which the garment may be partially threaded. In addition, accessories, such as jewelry and scarves, are often displayed from free standing full or partial mannequins. None of these devices, however, provides the numerous advantages of the present invention.

The present invention is an effective display unit satisfying the needs of the manufacturer, wholesaler, and retailer alike. The preferred embodiments of this invention offer maximum display area in a minimum amount of space for a large number of styles and variations of accessories, particularly scarves.

SUMMARY OF THE INVENTION

The present invention recognizes and addresses the foregoing disadvantages, and others, of prior art display apparatus. Accordingly, an object of the present invention is to provide a space efficient apparatus for the effective storage and simultaneous display of garments, accessories, and the like.

Another object of the present invention is to provide a storage and display unit which effectively displays garments without the necessity of removing the articles from the unit.

A further object of the present invention is to provide an accessory storage and display apparatus maximizing the number of accessories that can be displayed in a given space.

Yet another object of the present invention is to provide a display apparatus offering an instant view of a representative garment as it would normally be worn without the necessity of removing individually stored garments.

Another object of this invention is to provide a storage and display unit that effectively deters shoplifting.

Yet another object is to provide a flexible storage and display unit for utilization in a wide range of applications from small boutiques to large department stores.

Still another object of the present invention is to provide a versatile storage and display apparatus having a plurality of individual display and storage units for simultaneously displaying and storing a wide variety of garments, accessories, and the like.

Additional objects and advantages of the present invention will be set forth in part in the description which follows, and in part will be obvious from the description, or may be learned by practice of the invention. The objects and advantages of the invention may be realized and attained by means of the instrumentalities and combinations particularly pointed out in the appended claims. Various modifications and alterations to the features, elements, and constructions disclosed herewith may occur to those of ordinary skill in the art, and are intended to come within the spirit and scope of this invention by virtue of present reference thereto. Such modifications and variations may include, but are not limited to, the substitution of equivalent structures and elements, in whole or in part, for those expressly disclosed, illustrated, or suggested herein.

These and other objects of the present invention are achieved by providing an apparel display and storage apparatus, the display and storage apparatus including an upright support stand and a plurality of display units carried by the upright support stand and extending therefrom. Each display unit includes an upright support frame and a plurality of display racks extending generally horizontally from the upright support frame. The display racks are substantially equally horizontally spaced along the upright support frame. Each display rack further includes a plurality of spaced apart storage bars extending thereacross for receipt of the apparel thereover. Each display unit further includes a silhouette support member extending vertically from the upright support frame, and a silhouette supported by the silhouette support member, with the silhouette including a frontal display area for displaying the apparel or accessories as they would be worn by a user.

In a preferred embodiment, the display units are disposed around the support stand and attached thereto by extension arms extending radially outward from the stand in a manner so that the display units may rotate around the support stand. In a further preferred embodiment, the display units are arranged in a plurality of vertically spaced tiers along the support stand. Further, each display unit may include means for securing the garments carried by the storage bars. The garment securing means may include a locking bar affixed to the upright support frame generally opposite the display racks, the locking bar extending lengthwise across the upright support frame and including a garment rod, a swingable retaining gate which can be positioned generally adjacent the garment rod along the entire length thereof, and a clamping mechanism for securing the retaining gate adjacent the garment rod to lock the accessories therein.

In a further preferred embodiment, the invention is embodied as an individual display unit as described above as one aspect the display and storage apparatus. In accordance with the present invention, garments, accessories such as scarves, or other like articles are draped or folded around the storage bars of the respective display racks.

It should be understood that, although generally discussed with regards to accessories and scarves, the present invention is not limited to such applications. The present invention is just as useful and meant to encompass the storage and display of any variety of garment, material, or the like. The present invention is in no way limited to scarves and accessories.

Additional aspects and features of such exemplary embodiments and others are discussed in greater detail below.

BRIEF DESCRIPTION OF THE DRAWINGS

A full and enabling disclosure of the present invention, including the best mode thereof, to one of ordinary skill in the art is set forth more particularly in the remainder of this specification. The accompanying drawings, which are incorporated in and constitute a part of this specification, illustrate embodiments of the invention and together with the description, serve to explain the principles of the invention.

FIG. 8 is a side cross-sectional view of an exemplary embodiment of the display unit according to the present invention;

FIG. 9 is a perspective view of the locking bar depicted in FIG. 8;

FIG. 10 is a side view of an embodiment of the display racks and upright support frame of the present invention particularly illustrating the retractable coil which may be used as garment securing means in an exemplary of the present invention;

Figure 1:
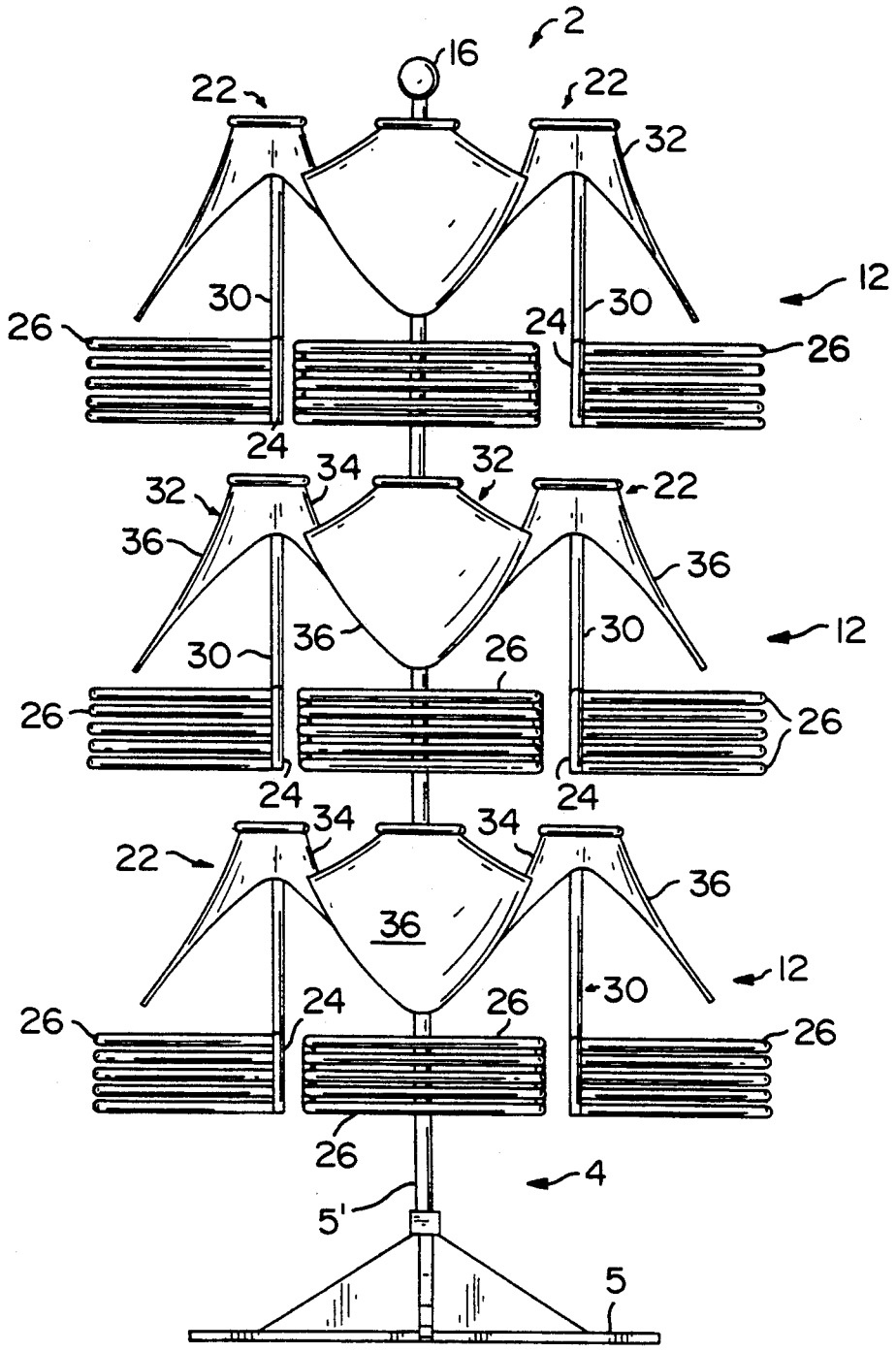
FIG. 1 illustrates a perspective view of an exemplary embodiment of a display and storage apparatus in accordance with the present invention with individual units arranged in tiers along and around the support stand.

Repeat use of reference characters in the following specification and appended drawings is intended to represent the same or analogous features or elements of the present invention.

DETAILED DESCRIPTION OF THE PREFERRED EMBODIMENTS

Reference will now be made in detail to the present preferred embodiments of the invention, examples of which are illustrated in the accompanying drawings. It is to be understood by those of ordinary skill in the art that the present discussion is a description of exemplary embodiments only, and is not intended as limiting the broader aspects of the present invention, which broader aspects are embodied in the exemplary constructions.

Figure 2:
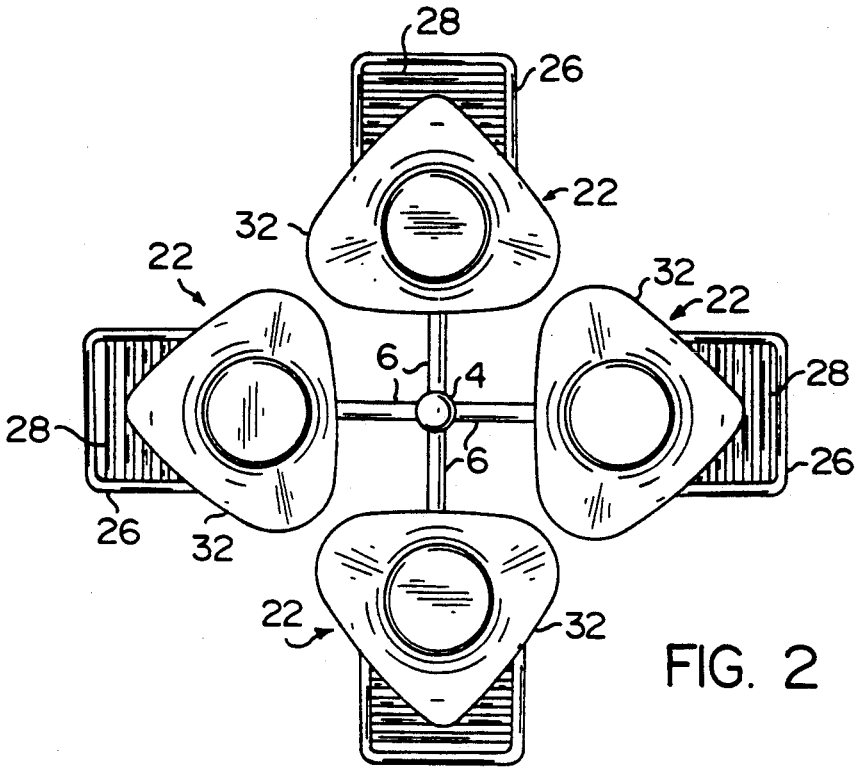
FIG. 2 is a top view of the embodiment depicted in FIG. 1.
Figure 3:
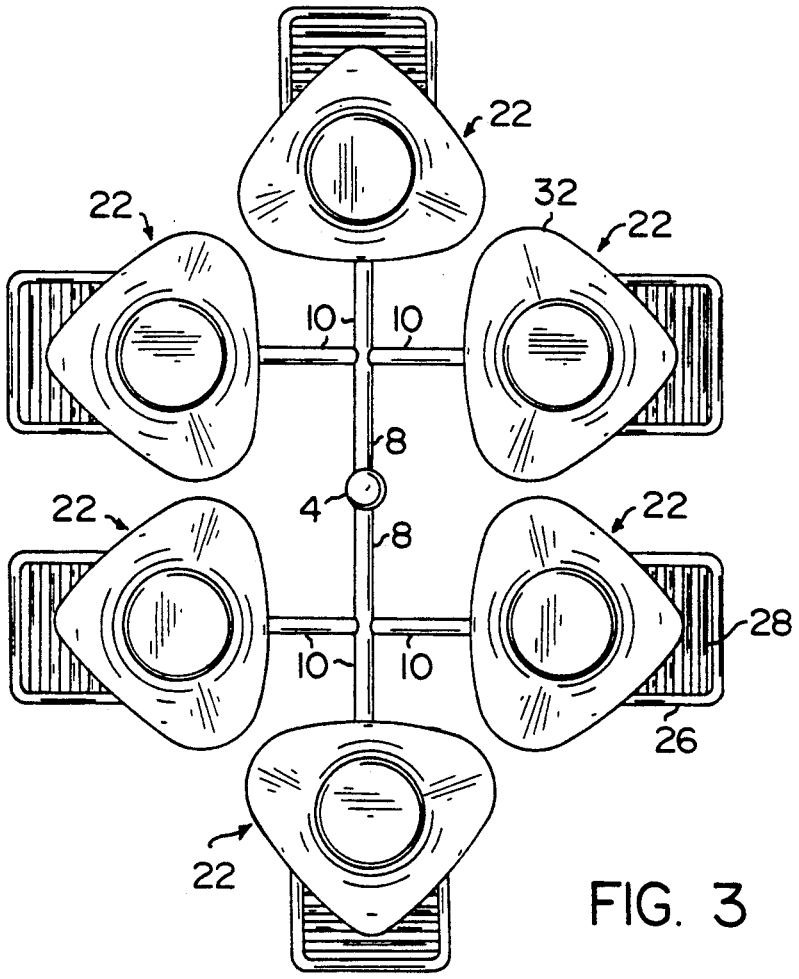
FIG. 3 is a top view of an exemplary embodiment of the present invention illustrating two extension branches with attached display units extending from the support stand in accordance with an embodiment of the present invention.
Figure 4:
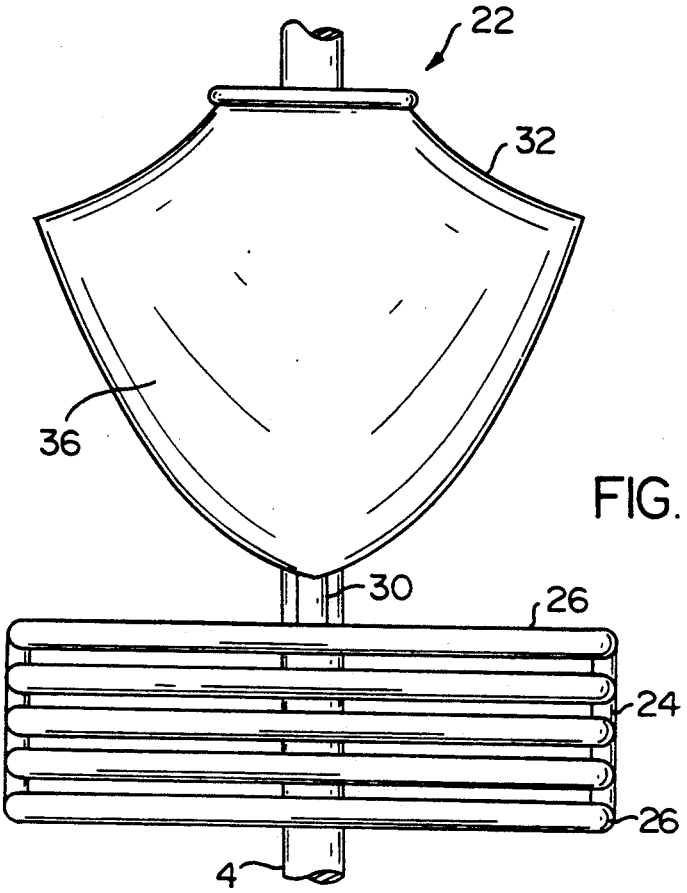
FIG. 4 is a frontal perspective view of an exemplary embodiment of an individual storage and display unit according to the present invention.

In accordance with the objects and scope of the present invention, an apparel display and storage apparatus 2 is illustrated generally in FIGS. 1–3. Storage and display apparatus 2 includes a plurality of display units 22 carried by an upright support stand 4.

As illustrated in FIGS. 1–3, display units 22 are disposed generally surrounding support stand 4. As particularly illustrated in FIG. 2, units 22 may be carried on support stand 4 by radially extending extension arms 6. Any number of units 22 may extend from support stand 4 at any given height or level. In a most preferred embodiment, as illustrated in FIG. 2, four units 22 are carried by stand 4 at a given height therealong.

Extension arms 6 may attach to units 22 at any suitable point, but preferably connect to a silhouette support member 30 as will be described in more detail below. Preferably, extension arms 6 are rotatable relative to stand 4 so that units 22 may revolve thereby giving apparatus 2 full circle display capability for all units 22.

In an alternative embodiment of the present invention, as embodied herein in FIG. 3, an extension branch 8 extends from stand 4. Extension branch 8 comprises appendages 10 to which units 22 are attached. In this embodiment, a greater number of units 22 can be carried by single support stand 4. Essentially, extension branch 8 and appendages 10 act as sub-stands extending from stand 4. In a preferred embodiment, as depicted in FIG. 3, two extension branches 8 are utilized, each having three appendages 10 carrying a total of six display units 22 on a given level. However, this illustration is not intended to be limitative of the present invention. For example, additional extension branches 8 of greater length may also be utilized between those shown in FIG. 3. Any arrangement of a stand such as 4 with generally radially extending extensions for supporting a plurality of units 22 is within the scope of the present invention. As shown in FIG. 1, stand 4 includes a base 5 to maintain it in upright position.

In one embodiment of the present invention as illustrated, for example, in FIG. 1, storage and display units 22 are arranged in tiers 12 along support stand 4. Preferably, units 22 of each tier are rotatable relative to stand 4 independent of the other tiers 12. The display units 22 on each tier 12 may be connected as a single unit and placed on the support stand in that manner. For example, the support stand may include a center rod 5' with holes therein and pins can be placed in these holes and an individual tier placed on top of each pin. This would allow the level of the tiers to be easily adjusted. The number of tiers 12 per device 2 is only limited by the height of stand 4. This embodiment is preferred in that it maximizes the display capability of apparatus 2 by vertically expanding the display area and not requiring additional floor space.

Units 22 may be affixed to stand 4 at tier 12 with extension arms 6 or extension branches 8, the use of extension branches giving more units 22 per tier 12. For example, in accordance with the present invention, a small apparel display and storage apparatus may contain three tiers with four display units 22 per tier for a total of twelve display units. In a preferred embodiment, this apparatus could display between 72 and 500 scarves. A larger display and storage apparatus may contain five tiers with six display units 22 per tier for a total of thirty display units. This apparatus could display and store between 180 and 1500 scarves. Of course, the capacity depends on the number of display units 22 and the capacity of each display unit, and any number of display units would be within the scope of the present invention.

Storage and display apparatus 2 may also include an ornamental fixture 16 disposed generally atop support stand 4. Fixture 16 may comprise any type of aesthetic device, such as a polished ball, mirror, manufacturer's designation or the like.

The individual apparel display units 22 according to the present invention will now be described in detail. One display unit 22 includes an upright support frame and a plurality of generally equally spaced display racks extending generally outwardly in a substantially horizontal orientation from upright support frame 24. As embodied herein and shown for example in FIGS. 4–8, and 11, display unit 22 comprises upright support frame 24 oriented vertically or in an upright manner and acting as a support structure for the display racks 26. From a weight and simplicity standpoint, upright support frame 24 is preferably a singular element constructed from any suitable lightweight framing material such as tubular metal alloy or plastic piping. Upright support frame 24 need not be singular, however, it could readily be constructed from any number of connecting components as would be apparent to one skilled in the art.

Figure 11:
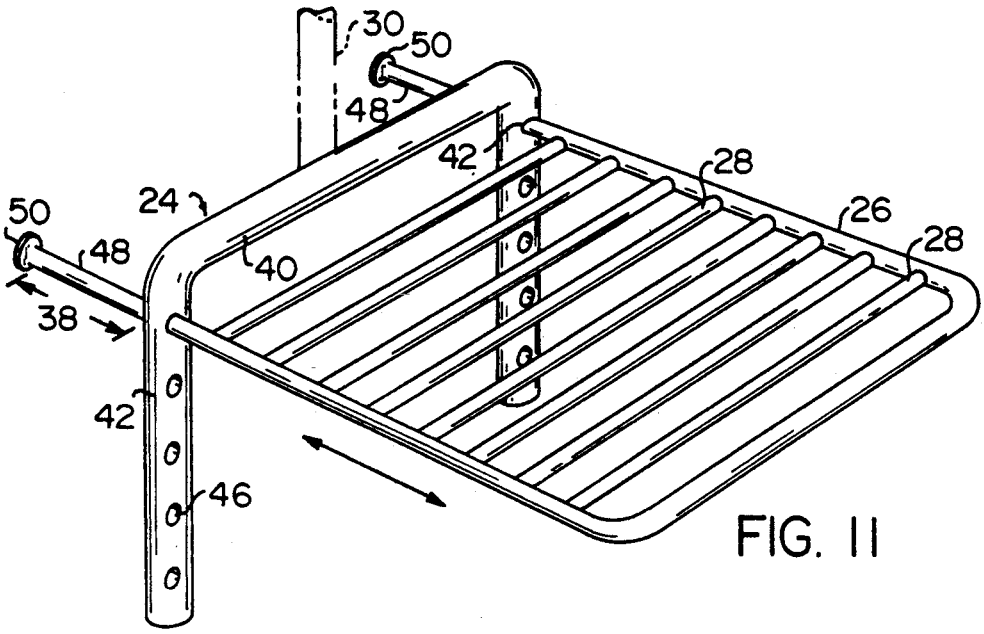
FIG. 11 illustrates a partial perspective view of an embodiment of the display unit in accordance with the present invention.

In a most preferred embodiment of this invention as illustrated particularly in FIG. 11, upright support frame 24 is generally rectangular or U-shaped having a top portion 40 and side arms 42. Of course, upright support frame 24 could be any number of shapes, for example, circular, square, or the like.

Figure 5:
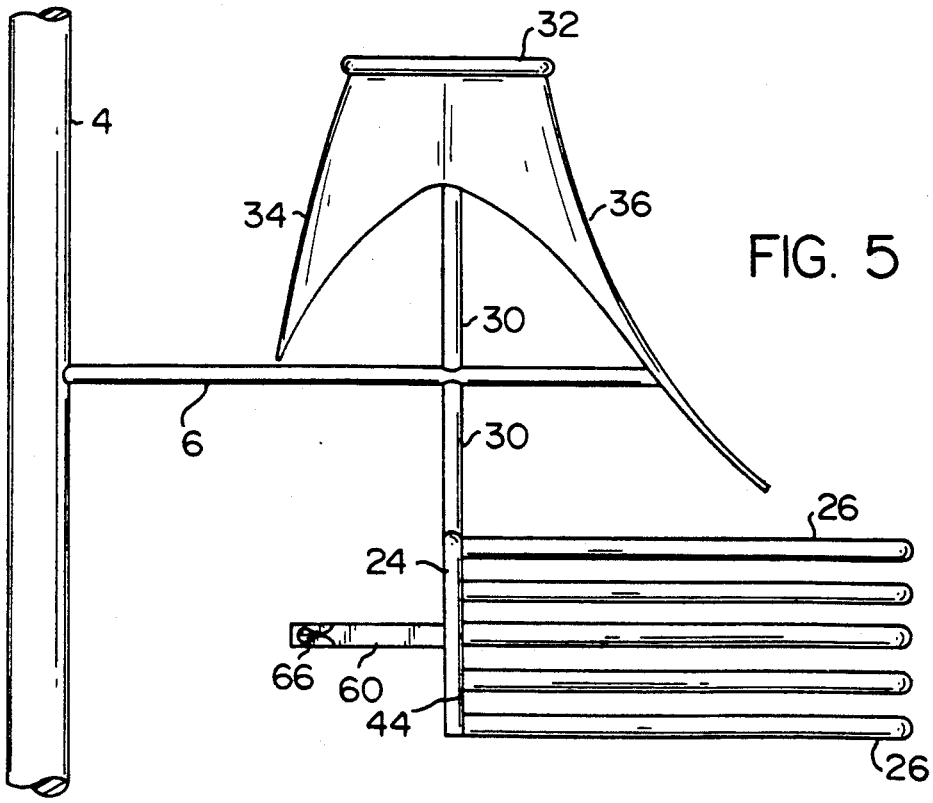
FIG. 5 is a side perspective view of the embodiment depicted in FIG. 4.

Located along side arms 42 are juncture points 44, as illustrated in FIGS. 5, 8, and 10. Juncture points 44 represent the points along side arms 42 where display racks 26 are affixed. Any known method for affixing display racks 26 to upright support frame 24 would be within the scope of the present invention. For instance, the racks and upright support frame may be welded, glued, soldered, brazed, bolted, etc. In one embodiment, upright support frame 24 and display racks 26 may actually be formed as a singular integral piece with juncture points 44 merely representing the conceptual juncture of the upright support frame and the racks.

In another preferred embodiment of the present invention, as depicted in FIG. 11, juncture points 44 consist of holes 46 formed in side arms 42. Holes 46 may extend partially or completely through side arms 42 depending on the manner in which display racks 26 are to be affixed to the upright support frame. For example, holes 46 may extend partially through side arms 42 with display racks 26 being force-fitted or friction fitted in holes 46. In the alternative, holes 46 may extend completely through side arms 42 with display racks 26 having extensions 48 extending completely through holes 46. Extensions 48 may include stop elements 50 attached to the ends thereof to prevent display racks 26 from being pulled completely out of upright support frame 24.

As embodied herein and shown for example in FIG. 11, display racks 26 are preferably, although not necessarily rectangular in shape. They may be constructed of any suitable material, such as metal alloy or plastic, and generally may be of smaller diameter than upright support frame 24. Display racks 26 may be at least partially coated with polyurethane or like coating to provide for smooth surfaces and enhanced appearance. Display racks 26 extend generally horizontally from upright support frame 24, being connected thereto at juncture points 44. By use of generally horizontal, it is intended that they may extend at a less than normal angle from upright support frame 24 but still be more horizontal than vertical.

Figure 13:
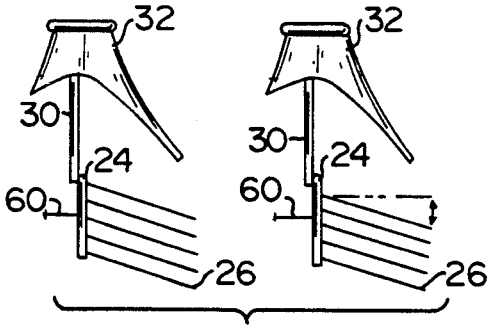
FIG. 13 is a side view of an embodiment of the storage and display units particularly illustrating pivotable display racks.

Display racks 26 may be rigidly affixed to upright support frame 24 or, in the alternative, movable relative thereto. For instance, in one preferred embodiment of the present invention, as illustrated in FIG. 13, display racks 26 are pivotally attached to upright support frame 24 so that they may extend at varying angles therefrom. This configuration allows a particular display rack 26 to be pivoted upwardly thereby providing a better view of the lower underlying display racks. In this manner, a customer may easily view the garments carried by the lower display racks 26. Additionally, this configuration facilitates the initial placement or subsequent replacement of garments on display racks 26. The pivotal connection can be by any conventional means as would be apparent to one of ordinary skill in this area.

Figure 12:
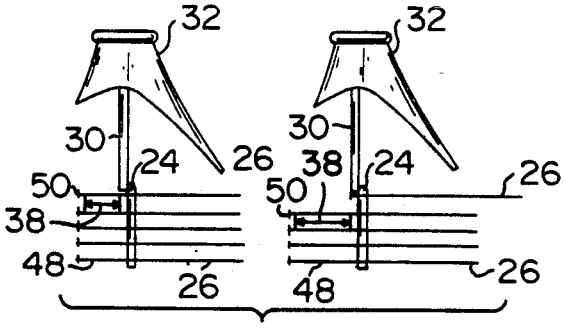
FIG. 12 is a side view of an embodiment of the storage and display units particularly illustrating slidable display racks.

In another preferred embodiment of the present invention, as depicted in FIG. 12, display racks 26 are slidable a fixed distance 38 back and forth relative upright support frame 24. As an example, distance 38 could be three inches, or any other suitable distance. Display racks 26 can be made slidable by any conventional means. For example, display racks 26 may include a telescoping portion generally at juncture points 44 whereby the rack can be pulled to its telescoped or fully extended position. Stop elements 50 attached to the ends of extensions 48 (which are readily slidable through holes 46) prevent display racks 26 from being pulled completely away from upright support frame 24 (see FIG. 11). In this configuration, customers may readily view lower display racks 26 by either pulling the desired rack out from the others or pushing the undesired racks in towards upright support frame 24.

It is also within the scope of the present invention for display racks 26 to be detachably affixed to upright support frame 24. A snap-fit or like means may be employed at juncture points 44 allowing customers or store employees to completely detach a desired display rack 26 from upright support frame 24 to more fully inspect the garments carried thereby.

Figure 14:
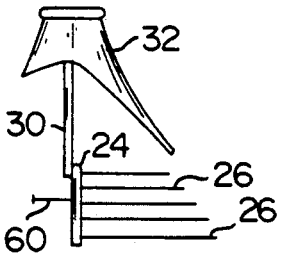
FIG. 14 is a side view of an embodiment of the storage and display units particularly illustrating display racks of varying length.

As embodied herein and shown for example in FIG. 14, display racks 26 may also be of varying length, preferably arranged shortest to longest from top to bottom. In this configuration, customers may simultaneously view the garments carried by all the racks.

It should be understood here that any combination of the embodiments of display racks 26 are within the scope of this invention. For example, display racks 26 may be pivotal and slidable; slidable and detachable; detachable and pivotal; pivotal, slidable, and detachable; or any other combination.

The display unit 22 of the present invention further comprises a plurality of generally equally spaced apart parallel storage bars extending across the display racks. As embodied herein and best illustrated in FIGS. 2, 3, 8, and 11, storage bars 28 extend across display racks 26 and are spaced apart a distance sufficient to allow garments to be readily wrapped or draped therearound. Storage bars 28 are preferably coated with a non-slippery foam-like substance to protect the garments carried thereby from being picked or blemished and to prevent the garments from sliding off storage bars 28. Storage bars 28 may be formed as an integral part of display racks 26 or constitute separate components affixed across display racks 26. To maximize the number of storage bars 28 per display rack 26, it is preferred to arrange storage bars 28 parallel to each other and uniformly spaced apart as illustrated in the Figures. Any number of storage bars per display rack could be provided. One example would be eight bars per rack.

Figure 6:
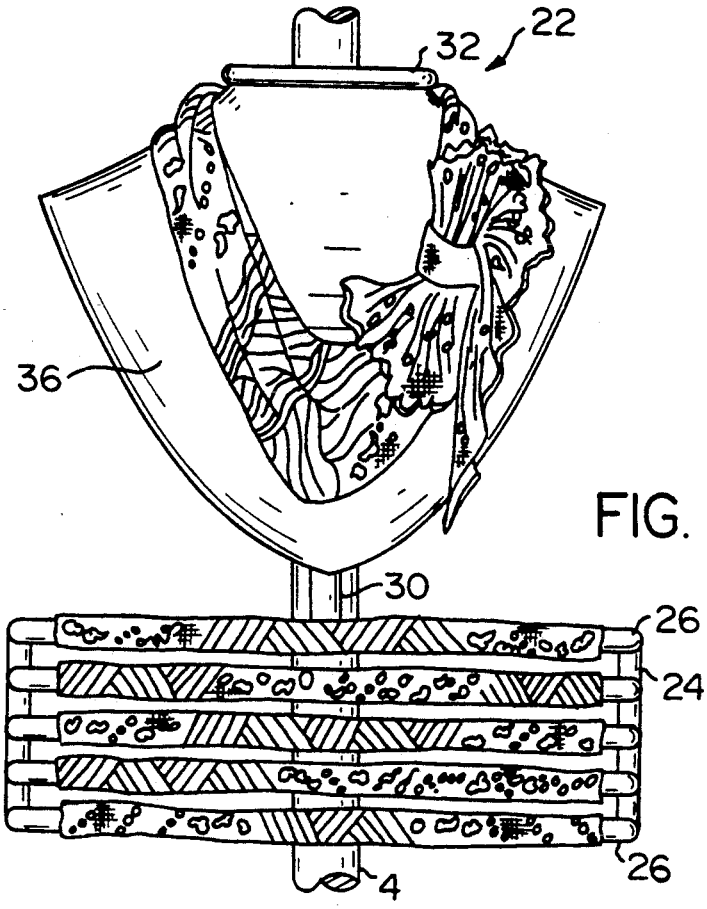
FIG. 6 illustrates the embodiment of FIG. 4 in actual use.

While generally referred to as storage bars, it should be noted that bars 28 also serve a very important display function. FIGS. 6 and 8 best illustrate the use and operation of storage bars 28. Scarves, accessories, or like articles to be stored and displayed are folded or wrapped around storage bars 28 with the excess of the articles being pulled back to drape behind the last storage bar 28. Smaller garments, for example handkerchiefs, may be carried completely by storage bars 28. In addition, more than one garment or article may be carried by each storage bar 28 depending on the size of the garments and how they are folded. Further, depending on the length of the scarf, etc., the scarf may be folded to adjust the amount extending to the rear of the racks. For example, the scarves may be folded in half prior to being placed on bars 28.

As shown for example in FIGS. 8–10 and 13–15, display unit 22 may further include garment securing means for securing articles carried by storage bars 28. In a preferred embodiment illustrated for example in FIGS. 8 and 9, garment securing means may include a locking bar 60 which extends across and is secured to upright support frame 24 generally opposite display racks 26. Locking bar 60 includes a garment rod 62, a pivotable retaining member 64, and a securing mechanism 66. Locking bar 60 may be rigidly affixed to upright support frame 24, comprise an integral part thereof, or be slidably attached so that it may be located anywhere along upright support frame 24.

As depicted in FIG. 8, articles carried by storage bars 28 are pulled back over and behind the rearmost storage bar 28 and draped over garment rod 62. Retaining member 64 is hinged at one end of locking bar 60 and may be pivoted or closed against garment rod 62, thereby securing the articles between garment rod 62 and retaining gate 64. A securing mechanism 66 is provided for maintaining retaining member 64 in its closed position. Any conventional type of securing mechanism or locking device may be utilized to maintain the articles in a secure position.

Locking bar 60 may be located anywhere along upright support frame 24 but preferably is disposed about halfway up the frame as shown in FIGS. 5 and 8. In this location, garments or articles of relatively equal length may be carried by storage bars 28 of the differing level display racks 26 with the excess of all of the garments being able to reach locking bar 60. In the alternative, locking bar 60 may be located near the bottom of upright support frame 24. In this embodiment, relatively short articles may be stored on lower display racks 26 and longer articles on upper display racks 26. Obviously, locking bar 60 may be located anywhere along upright support frame 24 to suit any combination of article lengths. In addition, the garments can be folded prior to being placed on bars 28 to reduce them to the desired length.

An alternative embodiment of the garment securing means is illustrated in FIG. 10. A retractable coil 68 is located on upright support frame 24 generally opposite display racks 26. Coil 68 may be formed of any coiled resilient material capable of being unrolled and subsequently returning to its coiled condition upon release. In operation, coil 68 is unrolled and the ends of the garments extending out the back of the display rack are laid upon it. When released, coil 68 returns to its coiled condition with the garments being rolled therein.

For clarity sake, FIG. 10 depicts a single coil 68 located generally halfway along upright support frame 24. In a preferred embodiment, retractable coil 68 is located generally near the bottom of upright support frame 24 so that articles from all levels of display racks 26 may be secured therein. In another preferred embodiment, one retractable coil 68 may be provided for each display rack 26 along the upright support frame 24.

Figure 15:
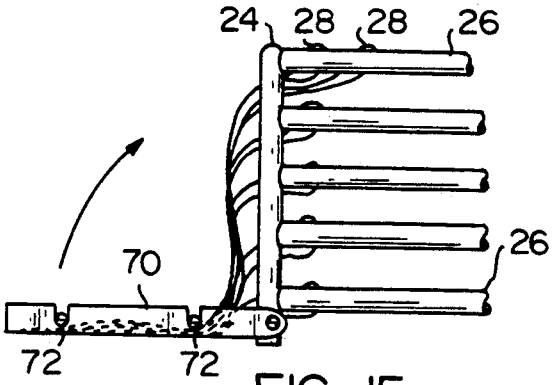
FIG. 15 is a partial side view of the display racks and upright support frame of the present invention particularly illustrating a fold down tray that may be used as garment securing means in an exemplary embodiment of the present invention.

Another embodiment of the garment securing means is illustrated in FIG. 15. Fold-down tray 70 is pivotally attached at the bottom of upright support frame 24 and is generally of the same or slightly larger dimensions thereof. Garments are draped down into tray 70 and at least one retaining device 72 is provided for holding the garments against tray 70. Any type retaining device 72 may be utilized here, such as a spring loaded or snap-fit bar mechanism, the only requirement being that it hold the garments against tray 70. With the garments held therein, fold-down tray 70 is pivoted adjacent upright support frame 24, preferably with a conventional locking mechanism securing it thereto. As illustrated in FIG. 15, multiple retaining devices 72 may be utilized.

As noted above, it is an object of this invention to provide a storage and display unit with an adequate anti-theft device. The garment securing means explained above serve this purpose. By securing the garments to the storage and display unit 22, the garment securing means effectively deter pilferage. A would be shop-lifter would, for instance, need to unlock locking bar 60, or uncoil retractable coil 68, or unlock and fold down tray 70 to have access to the garments. The required time and difficulty of these operations are deterrents in themselves.

Additionally, it is within the scope of this invention to include garment securing means that actually are "locked" into position with, for example, a lock and key or similar device. For example, in a preferred embodiment of the present invention as illustrated in FIGS. 8 and 9, locking mechanism 60 may include a lock and key unit to maintain retaining member 64 adjacent garment rod 62.

The storage and display unit 22 according to the present invention also includes a silhouette support member extending vertically from upright support frame 24 and a silhouette disposed above the upright support frame and affixed to the silhouette support member generally at the top thereof. As embodied herein and shown for example in FIGS. 1 and 4–8, silhouette support member 30 extends vertically upward from upright support frame 24, preferably from the middle of top portion 40 (see FIG. 11 also). Silhouette support member 30 may constitute a separate element formed from material similar to that used for upright support frame 24 and rigidly affixed thereto, or may be formed integrally with upright support frame 24. Although depicted in the Figures as a singular tubular element, it is within the scope of this invention for silhouette support member 30 to comprise any sort of vertically extending structure.

As illustrated, for example, in FIGS. 1 and 4–7, silhouette 32 presents a frontal display area 36 and a back area 34. Silhouette 32 provides a part of the display function of the present invention by providing means to exhibit garments, such as a scarf along with other accessories, as they would normally be worn by a customer. This feature is best illustrated in FIG. 6. In a preferred embodiment as depicted in FIGS. 4–7, silhouette 32 is modeled after a human upper body with frontal display area 36 being of particular interest. In this embodiment, frontal display area 36 slopes downward and forward towards display racks 26, closely resembling the frontal bust area of a person. However, silhouette is intended to encompass any type display area that would allow articles to be displayed in a manner similar to how they are actually worn.

Figure 7:
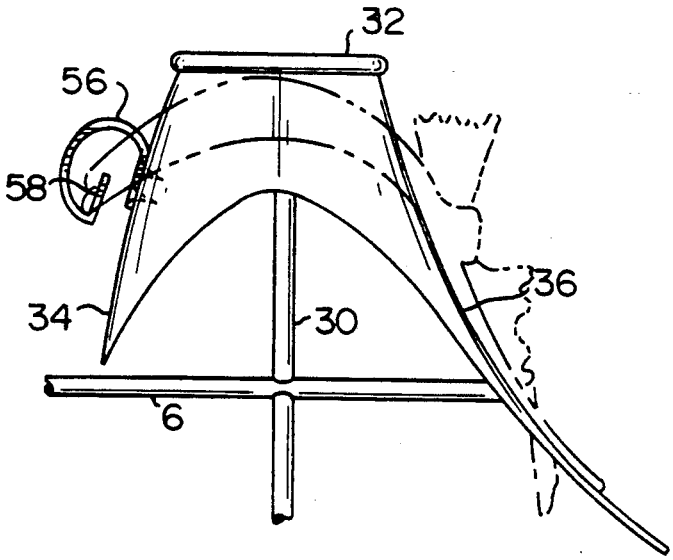
FIG. 7 is a side view of an embodiment of the silhouette of the present invention particularly depicting the arrangement of the garment holding device.

Silhouette 32 may be formed of any suitable material such as wood, cardboard, molded plastic or the like, etc. From a weight standpoint, it is preferred that silhouette 32 be essentially hollow or, in the alternative, without sides, as illustrated in FIGS. 5 and 7. Preferably, silhouette 32 is mounted or supported atop silhouette support member 30 and aligned such that frontal display area 36 is above display racks 26 as shown generally in the Figures, particularly FIG. 6. Silhouette 32 need not be atop neck element 30 but may also be supported or braced thereby. For example, silhouette 32 may be affixed to silhouette support member 30 at back area 34. The actual method of attachment is not important to the spirit of this invention.

As illustrated in FIG. 7, silhouette 32 may further include a displayed garment holding device 56. Displayed garment holding device 56 may comprise a simple hook 58 or any other suitable means for holding the displayed garments in place on silhouette 32.

In the embodiment of FIGS. 1 and 2, display unit 22 is secured to stand 4 by extension arm 6. Although extension arm 6 is illustrated as being affixed to silhouette support member 30, this is not necessary. Extension arm 6 could just as readily be affixed to silhouette 32, upright support frame 24, or anywhere on display unit 22. Display unit 22 is rotatably secured to stand 4 thereby giving it the ability to revolve around stationary stand 4.

Storage and display unit 22 may further be attached directly to its support means, without the use of an extension arm 6. The actual type of support means and arrangement thereof with display unit 22 is not of critical importance to the spirit of this invention and any type of known apparatus will suffice. The only requirement is that the support means be able to maintain unit 22 in its upright display configuration.

As would be apparent to one skilled in the art, all of the components of the present invention could be constructed of a variety of different materials including metal alloys, polymeric or reinforced paper products. An example of certain dimensions are as follows. The distance between the top of a silhouette on one level and the bottom of the display rack above it could be approximately 1 ½. The storage bars could be approximately ¾ in diameter and the racks on an individual display unit 22 could be approximately ⅝ apart. Of course, these are representative only and the important criteria would be convenience to the user and employee in viewing and stocking the apparatus, as well as the particular area it is to be used in.

It is to be understood by those of ordinary skill in the art that the foregoing specification and drawings discussed with reference thereto are only exemplary embodiments of the present invention, with all such language being by way of example only. Individual features and aspects of the foregoing exemplary embodiments may be varied for accommodating alternative applications, all without departing from the spirit and scope of the present invention set forth in the appended claims and their equivalents.

What is claimed is:

1. An apparel display and storage apparatus, said display and storage apparatus comprising:

a support stand;

a plurality of display units carried by said support stand and extending therefrom, each said display unit including (a) an upright support frame;

(b) a plurality of display racks extending generally horizontally from said upright support frame, said display racks being substantially equally vertically spaced along said upright support frame;

(c) a plurality of spaced apart storage bars extending across each said display rack for receipt of apparel thereover;

further including a silhouette support member extending vertically from said upright support frame; and a silhouette supported by said silhouette support member, said silhouette including a frontal display area for displaying the apparel as it would be worn.

2. The apparatus according to claim 1 and further comprising garment securing means carried by each of said display units for securing garments carried by said storage bars.

3. The apparatus according to claim 1 wherein said display units are disposed around said support stand and attached thereto by extension arms extending radially outward from said stand.

4. The apparatus according to claim 3 wherein said extension arms are rotatable relative said support stand so that said display units may rotate around said support stand.

5. The apparatus according to claim 3 wherein said display units are arranged in a plurality of vertically spaced tiers along said support stand.

6. The apparatus according to claim 5 wherein each tier includes four display units.

7. The apparatus according to claim 1 wherein said display units are attached to said support stand through an extension branch, said extension branch extending radially outward from said support stand and further comprising a plurality of appendages to which said display units are affixed.

8. The apparatus according to claim 7 wherein said extension branch is rotatable relative said support stand so that said display units may rotate around said support stand.

9. The apparatus according to claim 7 comprising a plurality of said extension branches arranged in tiers along said support stand.

10. The apparatus according to claim 1 wherein said display racks are pivotally affixed to said upright support frame so that said display racks may extend therefrom at varying angles relative said upright support frame.

11. The apparatus according to claim 2 wherein said display racks are slidably affixed to said upright support frame so that said display racks may slide a fixed distance back and forth relative said upright support frame.

12. The apparatus according to claim 2 wherein said garment securing means comprises a locking bar affixed to said upright support frame generally opposite said display racks, said locking bar extending lengthwise across said upright support frame and comprising a garment rod, a pivotal retaining member which can be positioned generally adjacent said garment rod along the length thereof, and a securing mechanism for securing said retaining member adjacent said garment rod.

13. An apparel display and storage unit comprising:

an upright support frame;

a plurality of display racks extending generally horizontally from said upright support frame, said display racks being substantially equally vertically spaced along said upright support frame, each said display rack comprising a plurality of spaced apart storage bars extending thereacross;

a silhouette support member extending vertically from said upright support frame; and a silhouette supported by said silhouette support member, said silhouette including a frontal display area.

14. The unit according to claim 13 wherein said display racks are pivotally affixed to said upright support frame so that said display racks may extend therefrom at varying angles relative said upright support frame.

15. The unit according to claim 13 wherein said display racks are slidably affixed to said upright support frame so that said display racks may slide a predetermined distance back and forth relative said upright support frame.

16. The unit according to claim 13 wherein said upright support frame comprises a substantially horizontal top portion and a plurality of downwardly extending side arms, said side arms being adapted to receive a portion of said display racks.

17. The unit according to claim 16 wherein said side arms define holes therethrough, said display racks further comprising extensions extending through said holes, said extensions having stop elements affixed to the ends thereof.

18. The unit according to claim 17 wherein said display racks are slidable a fixed distance back and forth relative said upright support frame.

19. The unit according to claim 13 wherein said display racks are of varying lengths.

20. The unit according to claim 13 wherein said silhouette further comprises a displayed garment holding device affixed generally opposite said frontal display area for maintaining displayed garments in place.

21. The unit according to claim 13 further comprising garment securing means for securing garments carried by said storage bars.

22. The unit according to claim 21 wherein said garment securing means comprises a locking bar affixed to said upright support frame generally opposite said display racks, said locking bar extending lengthwise across said upright support frame and comprising a garment rod, a pivotable retaining member which can be positioned generally adjacent said garment rod along the length thereof, and a securing mechanism for securing said retaining member adjacent said garment rod.

23. The unit according to claim 21 wherein said garment securing means comprises at least one retractable coil affixed to said upright support frame generally opposite said display racks, said retractable coil adapted to be uncoiled so that garments may be placed thereon and rolled within said retractable coil upon its subsequent recoiling.

24. The unit according to claim 21 wherein said garment securing means comprises a fold-down tray pivotally attached to said upright support frame, said fold-down tray comprising at least one retaining device for securing therein garments carried by said storage bars and draped down within said tray, said tray being adapted to be folded up to generally abut said upright support frame.

25. An apparel display and storage apparatus, said display and storage apparatus comprising:

a support stand;

a plurality of display units carried by said support stand and extending therefrom, each said display unit including (a) an upright support frame;

(b) a plurality of display racks extending generally horizontally from said upright support frame, said display racks being substantially equally vertically spaced along said upright support frame;

(c) a plurality of spaced apart storage bars extending across each said display rack for receipt of apparel thereover; and further comprising actuating garment gripping means carried by each of said display units for being actuated to thereby grip garments carried by said storage bars.

* * * * *

UNITED STATES PATENT AND TRADEMARK OFFICE

CERTIFICATE OF CORRECTION

PATENT NO. : 5,248,047
DATED : September 28, 1993
INVENTOR(S) : Randhawa

It is certified that error appears in the above-indentified patent and that said Letters Patent is hereby corrected as shown below:

Column 3, line 54, after "exemplary" add --embodiment--.
Column 10, line 4, after "1-1/2" add --"--.
Column 10, line 4, delete "3/4" and replace with --3/8"--.
Column 10, line 6, after "5/8" add --"--.

Signed and Sealed this

Seventh Day of June, 1994

*Attest:*

Bruce Lehman

BRUCE LEHMAN

*Attesting Officer*

*Commissioner of Patents and Trademarks*